US007550062B2

(12) United States Patent
Bartelmuss et al.

(10) Patent No.: US 7,550,062 B2
(45) Date of Patent: Jun. 23, 2009

(54) METHOD AND SYSTEM FOR CONTROLLING THE TEMPERATURE OF CERAMIC ELEMENTS IN A SUPPORTING OR WIPING STRIP IN A PAPER PRODUCTION FACILITY, AND SUPPORTING OR WIPING STRIP

(76) Inventors: Klaus Bartelmuss, Nr. 63, Teufenbach (AT) A-8833; Heinz Bartelmuss, Nr. 63, Teufenbach (AT) A-8833

( * ) Notice: Subject to any disclaimer, the term of this patent is extended or adjusted under 35 U.S.C. 154(b) by 141 days.

(21) Appl. No.: 11/786,817

(22) Filed: Apr. 13, 2007

(65) Prior Publication Data

US 2007/0240840 A1 Oct. 18, 2007

(30) Foreign Application Priority Data

Apr. 13, 2006 (AT) ..... A 644/2006

(51) Int. Cl.
*D21F 5/00* (2006.01)

(52) U.S. Cl. ..... 162/375; 162/198; 162/263; 162/352; 162/208; 700/128

(58) Field of Classification Search ..... 162/375, 162/198, 208, 263, 211, 352, 351; 700/128, 700/129

See application file for complete search history.

(56) References Cited

U.S. PATENT DOCUMENTS

| | | | | | |
|---|---|---|---|---|---|
| 5,061,347 | A | * | 10/1991 | Bubik et al. | 162/301 |
| 5,262,010 | A | * | 11/1993 | Bubik et al. | 162/352 |
| 5,314,585 | A | * | 5/1994 | Ward | 162/274 |
| 6,752,909 | B2 | | 6/2004 | Halmschlager et al. | |
| 6,821,389 | B2 | | 11/2004 | Halmschlager et al. | |
| 2004/0069431 | A1 | * | 4/2004 | Pitt | 162/352 |

FOREIGN PATENT DOCUMENTS

| | | | |
|---|---|---|---|
| DE | 40 28126 | * | 3/1992 |
| EP | 1 260 633 B1 | | 2/2007 |

* cited by examiner

*Primary Examiner*—Mark Halpern
(74) *Attorney, Agent, or Firm*—Laurence A. Greenberg; Werner H. Stemer; Ralph E. Locher

(57) ABSTRACT

The temperature of the ceramic elements of a supporting or wiping strip that is assigned to a wire or a felt in a paper production facility, is controlled by guiding a cooling carrier medium or a heating carrier medium through the supporting or wiping strip. For that purpose, the supporting or wiping strip is formed with at least one channel, through which the carrier medium for heat or for cold is pumped.

12 Claims, 8 Drawing Sheets

METHOD AND SYSTEM FOR CONTROLLING THE TEMPERATURE OF CERAMIC ELEMENTS IN A SUPPORTING OR WIPING STRIP IN A PAPER PRODUCTION FACILITY, AND SUPPORTING OR WIPING STRIP

CROSS-REFERENCE TO RELATED APPLICATION

This application claims the priority, under 35 U.S.C. § 119, of Austrian application A 644/2006, filed Apr. 13, 2006; the prior application is herewith incorporated by reference in its entirety.

BACKGROUND OF THE INVENTION

Field of the Invention

The invention lies in the field of papermaking facilities. More specifically, the present invention relates to a method for controlling the temperature of the ceramic elements of a supporting or wiping strip which, in a system for paper production, is assigned to the at least one wire or at least one felt located in said system. Furthermore, the invention relates to a device and a supporting or wiping strip for implementing the method.

Systems for paper production have at least one wire mesh belt—generally referred to as a "wire"—and, in addition, at least one felt belt—generally referred to as a "felt." The two belts are assigned supporting strips following one another in their direction of movement and oriented transversely with respect to the belts, over which the wire and the felt are guided. In a first region of the paper production system, the supporting strips also serve as wiping strips for the liquids emerging from the paper stock and passing through the wire. Since these supporting strips are subjected to high mechanical and corrosive loadings, there is the need to provide these with plates of a ceramic material on their surfaces facing the wires or the felts, on which surfaces the wire or the felt come to rest.

On the one hand, the wire or the felt is moved over the supporting strips at very high speeds of, for example, 40 m/sec. On the other hand, underneath the supporting strips there are devices for extracting the liquids emerging from the paper stock or for extracting air in order to dry the paper web resting on the wire or for drying the felt, as a result of which the wire and the felt rest on the supporting strips with very high pressure. As a result, frictional forces occur, by which the ceramic elements can be heated intensely.

If the system for paper production is not in operation, the supporting strips cool down to the ambient temperature. As soon as the system is started up, the paper stock, which can have a temperature of up to 90° C., is sprayed onto the wire. Furthermore, above the wire a steam hood can be provided, withwherein there is hot steam, which is used to dry the paper web and by which the ceramic elements can have temperatures up to 150° C. applied to them. At the same time, it is necessary to take into account the fact that the ceramic elements of the supporting or wiping strips have a very low thermal conductivity.

On account of the facts presented above, the ceramic elements of the supporting or wiping strips are subjected to very high thermal loads, which can change within a range of about 200° C. within very short time periods.

As a result of these thermal loads, there is the risk that cracks or fractures will occur in the ceramic elements. Here, there is the need to change the supporting or wiping strips without delay since otherwise the wire or the felt will be damaged, which means that the production operation will be impaired and operational failures can be caused.

On account of the facts explained above, in such systems damage to the ceramic elements caused on account of high temperature fluctuations must be avoided without fail.

European patent EP 1 260 633 B1 and its counterpart U.S. patents U.S. Pat. Nos. 6,752,909 B2 and 6,821,389 B2 disclose equipping the ceramic elements of supporting or wiping strips in paper production systems with temperature sensors. By way of these sensors, firstly the existing temperatures can be determined and secondly rapidly changing temperatures in the ceramic elements can be detected. This produces the possibility of controlling the operation of the system in such a way that impermissible temperature values or rapid changes in the temperatures of the ceramic elements are avoided. However, this method does not meet the requirements since there are different thermal conditions in different regions of the system for paper production, for which reasons impermissible thermal loadings of ceramic elements, which can occur in individual regions of the system, cannot be avoided by means of controlling the entire system.

SUMMARY OF THE INVENTION

It is accordingly an object of the invention to provide a system and a method, which overcome the above-mentioned disadvantages of the heretofore-known devices and methods of this general type and which enable the individual supporting or wiping strips located in a system for paper production to be protected against being damaged as a result of thermal stresses occurring therein.

With the foregoing and other objects in view there is provided, in accordance with the invention, a method for controlling a temperature of a ceramic element of a supporting or wiping strip assigned to a wire or a felt in a paper production facility. The supporting or wiping strip is formed with at least one channel; and the method comprises guiding a carrier medium for heat or for cold through the at least one channel.

In other words, the objects of the invention are achieved in that the supporting or wiping strips are formed with at least one channel, through which a carrier medium for heat or cold is led.

According to a first preferred method, a mixing valve is provided in the line leading to the at least one channel, to which mixing valve lines for carrier media for heat and for cold, respectively, are connected and which is set to the temperature which the relevant supporting or wiping strip is intended to have. In this case, a temperature sensor can be provided in the line leading away from the supporting or wiping strip, by means of which the temperature of the carrier medium flowing away from the supporting or wiping strip is measured. In addition, a temperature sensor can also be provided in the line leading to the supporting or wiping strip, by means of which the temperature of the carrier medium flowing toward the supporting or wiping strip is measured.

According to a second preferred method, the temperature of the carrier medium flowing toward the supporting or wiping strip is controlled as a function of the temperature of the carrier medium flowing away from the latter. In this case, the carrier medium can be conveyed by means of a delivery pump in an intrinsically closed circuit. Furthermore, the carrier medium flowing away from the supporting or wiping strip can be led either via a heating device or via a cooling device and then supplied to the supporting or wiping strip. The heating device or the cooling device can be controlled as a function of the temperature of the carrier medium flowing away from the supporting or wiping strip. As an alternative to this, the output of the delivery pump can be controlled as a function of the temperature of the carrier medium flowing away from the supporting or wiping strip. In addition, both the outputs of the heating device and of the cooling device and the output of the delivery pump can be controlled as a function of the temperature of the carrier medium flowing away from the supporting or wiping strip. The carrier medium is preferably led continuously through the supporting or wiping strip, being led in particular through the ceramic elements of the supporting or wiping strip.

In a system according to the invention for implementing this method for controlling the temperature of the ceramic elements of a supporting or wiping strip in a system for paper production, the supporting or wiping strip is formed with at least one channel, to which lines for carrier medium flowing to the supporting or wiping strip and for carrier medium flowing away from the latter are connected.

According to a first embodiment, in the line leading toward the at least one channel there is a mixing valve for carrier media for heat and for cold. Furthermore, in the line leading toward the supporting or wiping strip and/or in the line leading away from the supporting or wiping strip there can be a temperature sensor.

According to the second embodiment, a line system is provided wherein there are a delivery pump, a heating device and a cooling device for the carrier medium, furthermore at least one temperature sensor for determining the temperature of the carrier medium flowing away from the supporting or wiping strip and also a control unit for controlling the outputs of the heating device and the cooling device and/or the delivery pump being provided. In this case, at least one temperature sensor for determining the temperature of the carrier medium supplied to the supporting or wiping strip can also be provided.

A supporting or wiping strip according to the invention for implementing this method is formed with at least one channel to conduct a carrier medium for heat or for cold. In this case, the channel can pass through the ceramic elements. Furthermore, the channel can be located between the ceramic elements and a carrier strip for the ceramic elements. In addition, the channel can begin at one end of the supporting or wiping strip and end at the other end of the same or the channel can begin at one end of the supporting or wiping strip and be led back in the latter to the same end. In this case, the channel running forward can be connected to the channel running back within the supporting or wiping strip. In addition, the channel running forward can be connected to the channel running back via a piece of pipe located outside the supporting or wiping strip. Moreover, both the ceramic elements and the carrier strip can be formed with at least one channel or with channel portions.

Other features which are considered as characteristic for the invention are set forth in the appended claims.

Although the invention is illustrated and described herein as embodied in method for controlling the temperature of the ceramic elements of a supporting and wiping strip in a system for paper production, and device and supporting or wiping strip for implementing this method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
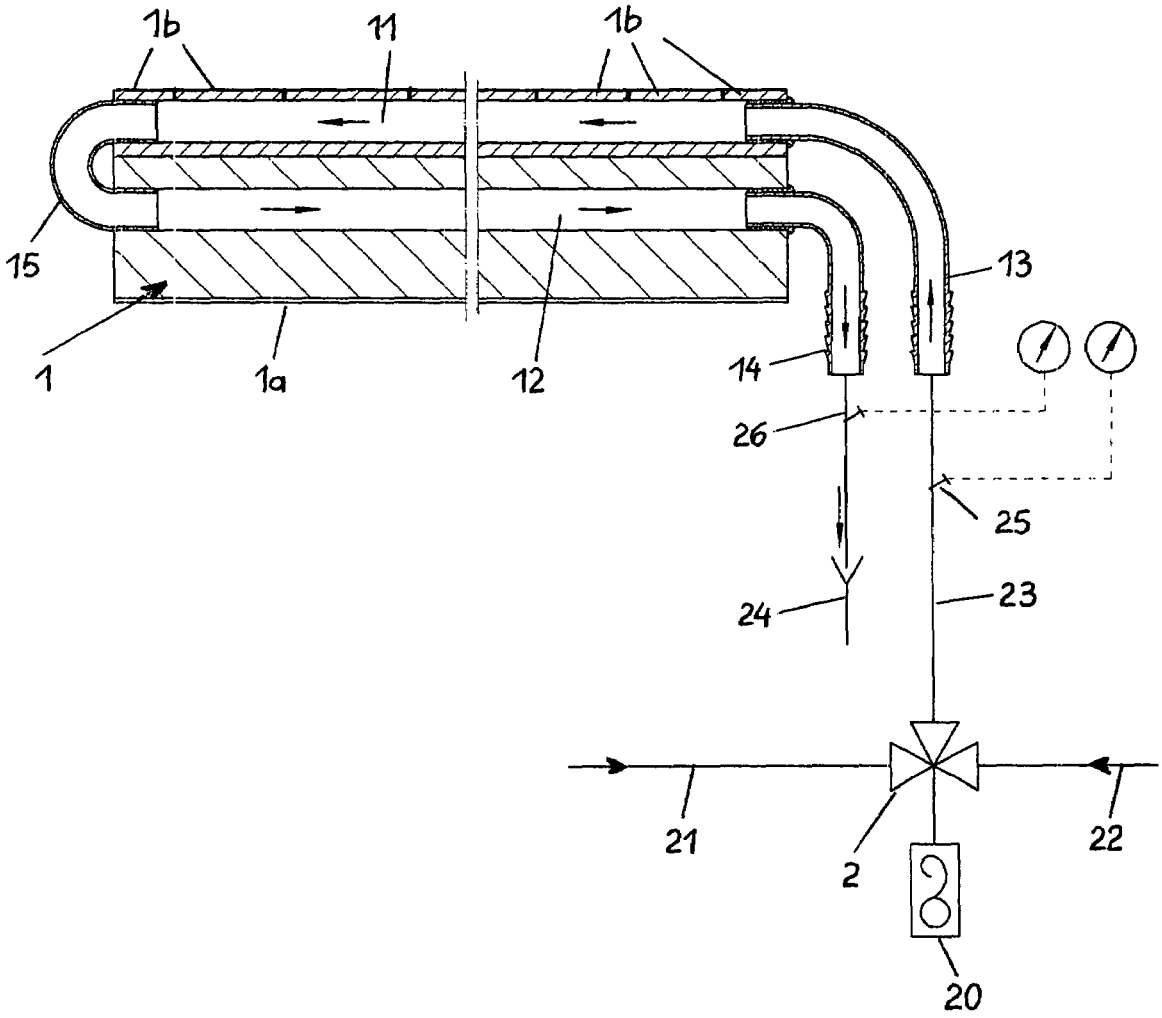
FIG. 1 is a schematic illustration of a device for implementing a first method according to the invention.

Referring now to the figures of the drawing in detail, the temperature control of a supporting or wiping strip 1 will first be explained with reference to FIG. 1. In this case, the supporting or wiping strip 1 comprises a carrier strip 1*a* having ceramic elements 1*b* fixed to the latter, the supporting or wiping strip 1 being formed with two channels 11 and 12. At one end of the supporting or wiping strip 1, the ends of the two channels 11 and 12 are adjoined by connecting pipes 13 and 14. At the other end of the supporting or wiping strip 1, the two channels 11 and 12 are connected to each other by way of a piece of pipe 15.

The connecting pipe 13 connects to an output line 23 from a mixing valve 2 to which a carrier medium for cold is fed via a first connecting line 21 and a carrier medium for heat is fed via a second connecting line 22. The connecting pipe 13 or the combination of the pipe 13 and the output line 23 may be referred to as a feed line. By means of a control device 20, the temperature of the carrier medium, or heat exchange medium, discharged by the mixing value 2 via the output line 23 is set to that temperature value which that supporting or wiping strip 1 in the system which is fed with carrier medium via the mixing valve 2 is intended to have.

During operation of the system for paper production, the temperature which a supporting or wiping strip 1 located in a specific region of the system is intended to have is defined. The mixing valve 2 is then set to this temperature. In this way, by means of the carrier medium supplied to the supporting or wiping strip 1 via the output line 23 from the mixing valve 2, this strip 1 is brought to the intended temperature. The carrier medium flowing away from the supporting or wiping strip 1 via the pipe 14 and heated or cooled by said strip is led away via a further line 24, either into a reservoir or into the sewer. The pipe 14 or the combination of the pipe 14 and the line 24 may be referred to as a return line.

Moreover, in the lines 23 and 24 temperature sensors 25 and 26 are provided, by means of which the temperatures of the carrier medium flowing through these lines are registered.

By means of this method, as a rule the temperature of the relevant supporting or wiping strip 1 can be brought close to the intended value.

Figure 2:
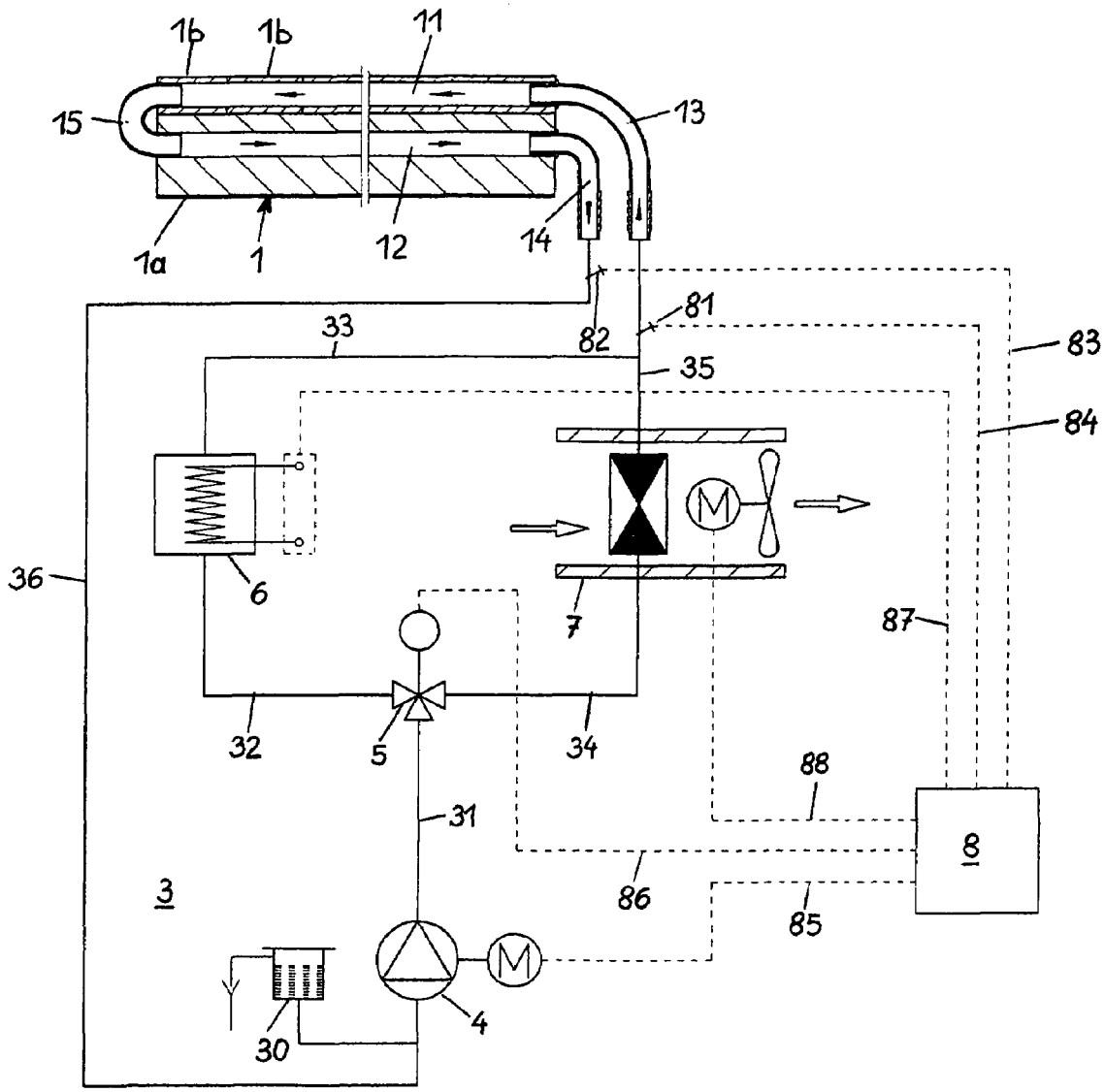
FIG. 2 is a schematic illustration of a device for implementing a second method according to the invention.
Figure 3:
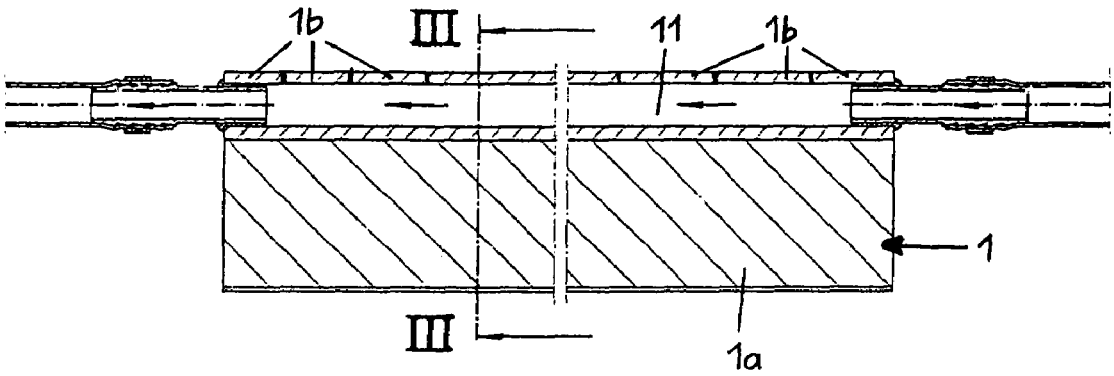
FIG. 3 is a longitudinal section through a first embodiment of a supporting or wiping strip according to the invention.
Figure 3A:
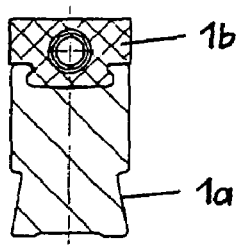
FIG. 3A is a section taken along the section line III-III in FIG. 3.
Figure 4:
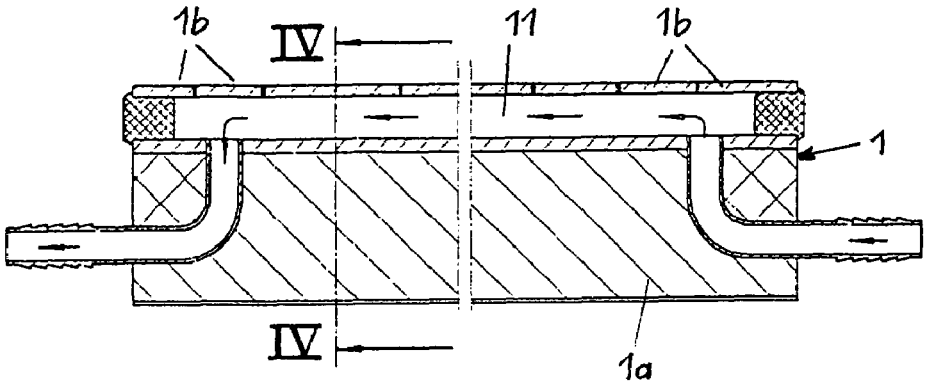
FIG. 4 is a longtidudinal section of a second embodiment of a supporting or wiping strip according to the invention.
Figure 4A:
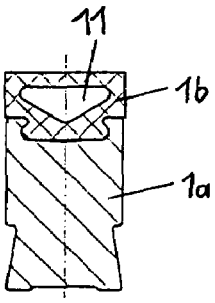
FIGS. 4A, 4B, 4C and 4D are sections taken along the line IV-IV in FIG. 4.
Figure 4B:
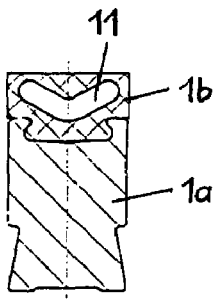
Figure 4C:
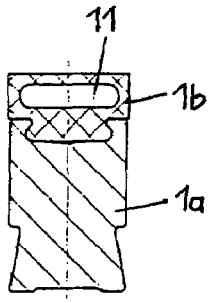
Figure 4D:
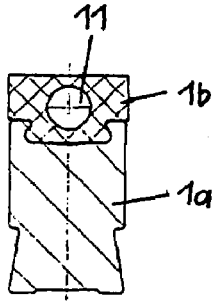
Figure 5:
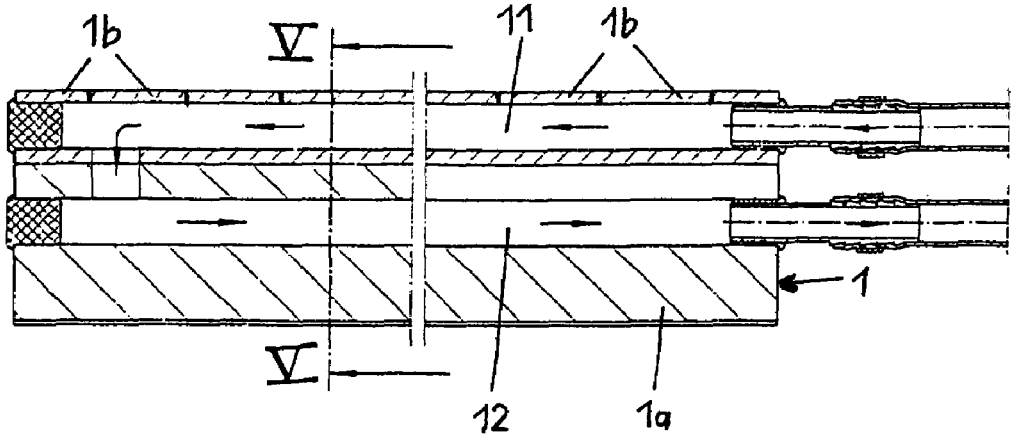
FIG. 5 is a longtidudinal section of a third embodiment of a supporting or wiping strip according to the invention.
Figure 5A:
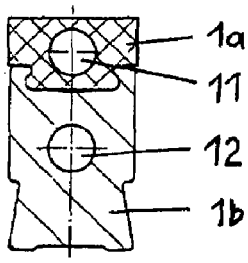
FIG. 5A is a section taken along the line V-V in FIG. 5.
Figure 6:
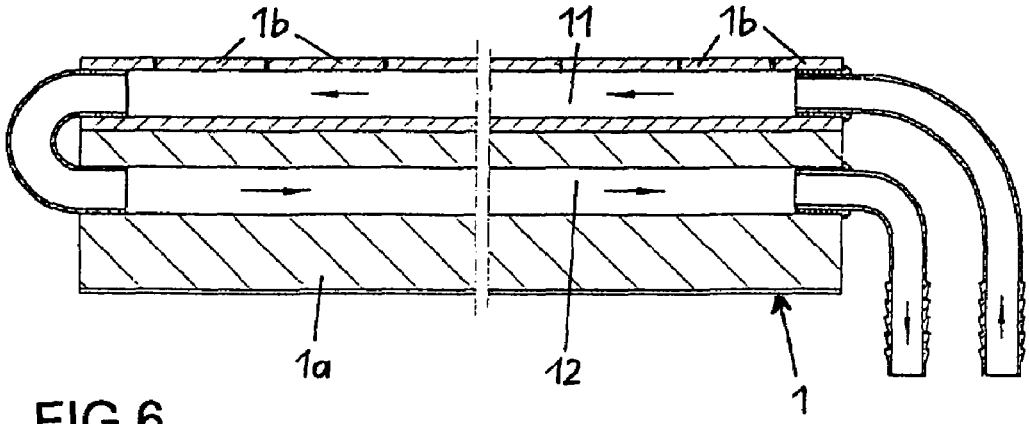
FIG. 6 is a longitudinal section of a fourth embodiment of a supporting or wiping strip according to the invention.
Figure 7:
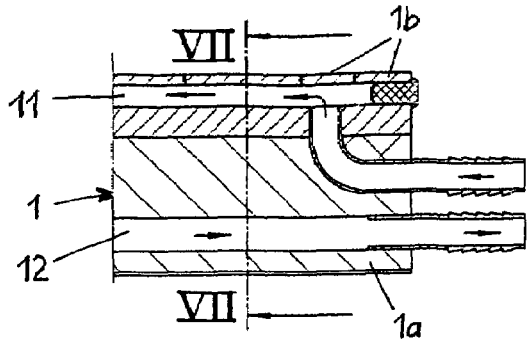
FIG. 7 is a longtidudinal section of a fifth embodiment of a supporting or wiping strip according to the invention.
Figure 7A:
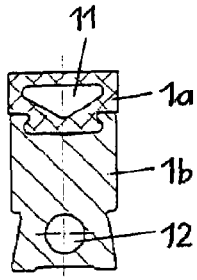
FIGS. 7A, 7B, and 7C are sections taken along the line VII-VII in FIG. 7.
Figure 7B:
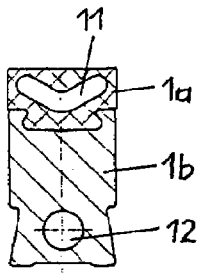
Figure 7C:
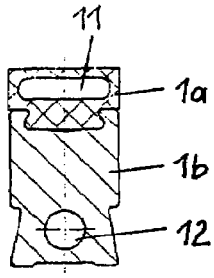
Figure 8:
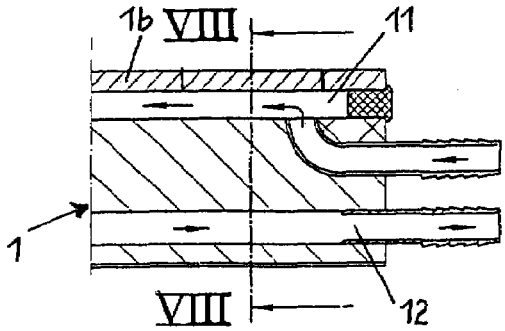
FIG. 8 is a longtidudinal section of a sixth embodiment of a supporting or wiping strip according to the invention.
Figure 8A:
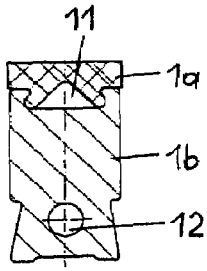
FIGS. 8A and 8B are sections taken along the line VIII-VIII in FIG. 8.
Figure 8B:
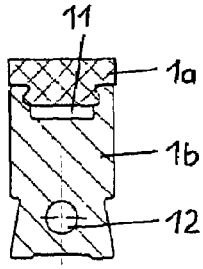
Figure 9:
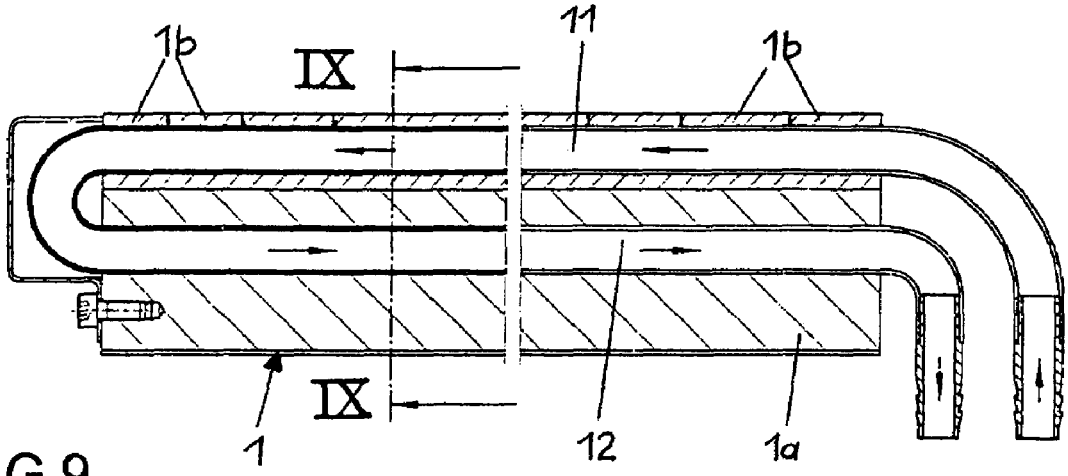
FIG. 9 is a longtidudinal section of a seventh embodiment of a supporting or wiping strip according to the invention.
Figure 9A:
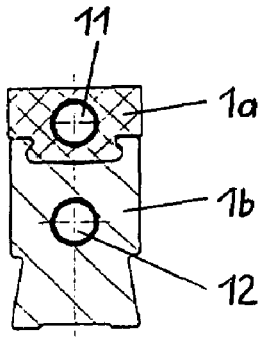
FIG. 9A is a section taken along the line IX-IX in FIG. 9.
Figure 10:
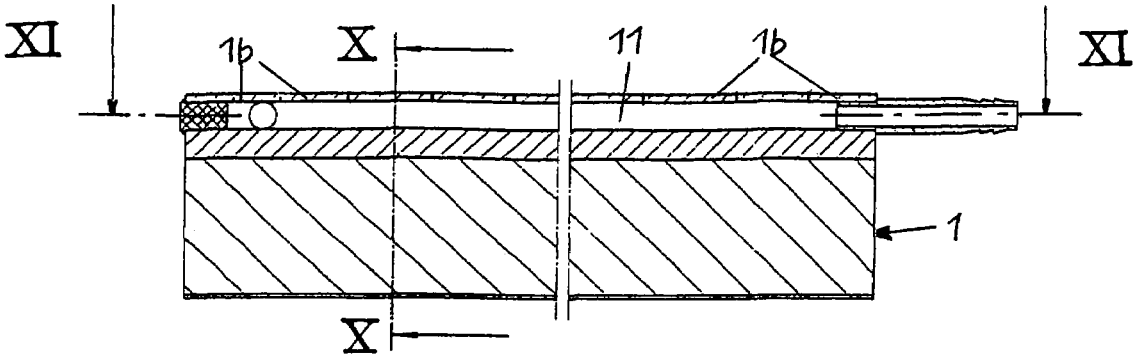
FIG. 10 is a longtidudinal section of a fifth embodiment of a supporting or wiping strip according to the invention.
Figure 10A:
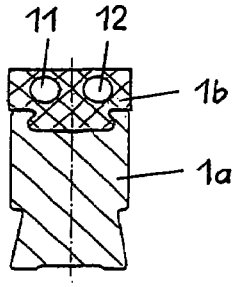
FIG. 10A is a section taken along the line X-X in FIG. 10.
Figure 10B:
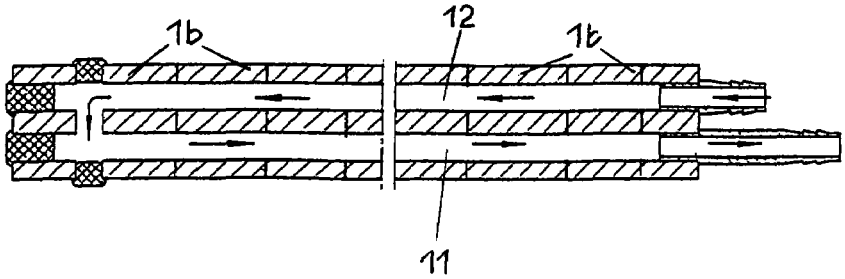
FIG. 10B is a section taken along the line XI-XI in FIG. 10.

According to the second method, explained with reference to FIG. 2, the supporting or wiping strip 1 is assigned an intrinsically closed circuit 3 for a carrier medium for heat or cold, wherein there are a reservoir 30 for the carrier medium, a delivery pump 4, a control valve 5, a heating device 6 and a cooling device 7. Also provided is a control unit 8, which is assigned two temperature sensors 81 and 82 located in the circuit 3 and which are used to control the delivery pump 4, the control valve 5, the heating device 6 and the cooling device 7.

The functionality of the device is as follows:

By means of the delivery pump 4, carrier medium for heat or cold is guided via a line 31 to the control valve 5, from which it is conveyed either via a line 32 to the heating device 6 or via a line 34 to the cooling device 7. From the heating device 6 or from the cooling device 7, heated or cooled carrier medium passes via a line 33 or 35 and via the connecting pipe 13 into the channel 11 of the supporting or wiping strip 1 and, and via the piece of pipe 15, into the channel 12. The return flow of the carrier medium takes place via the pipe 14 and the line 36 to the delivery pump 4.

By means of the first temperature sensor 81, located in the line 35, a measurement of the temperature of the carrier medium flowing toward the supporting or wiping strip 1 is carried out and, by means of the temperature sensor 82 located in the line 36, a measurement of the temperature of the medium flowing away from the supporting or wiping strip 1 is carried out. The measured values output by the temperature sensors 81 and 82 are transmitted via control lines 83 and 84 to the control unit 8, from which, via control lines 85, 86, 87 and 88, the delivery pump 4, the control valve 5, the heating device 6 and the cooling device 7 are controlled.

As soon as it is established by the control unit 8 on the basis of the measured value output by the temperature sensor 82 that the temperature existing in the supporting strip 1 must be increased, the control valve 5 is changed to the effect that the carrier medium is fed by means of the delivery pump 4 to the heating device 6, wherein it is heated, whereupon it is led into the channel 11 via the connecting pipe 13. This procedure is maintained until the supporting or wiping strip 1 has the temperature required for the specific operating case. By contrast, if it is established by the control unit 8 that the temperature existing in the supporting or wiping strip 1 must be reduced, the control valve 5 is changed to the effect that the carrier medium is fed by means of the delivery pump 4 to the cooling device 7, wherein it is cooled, whereupon it is likewise led via the connecting pipe 13 into the channel 11.

This procedure is likewise maintained until the supporting or wiping strip 1 has the temperature required for the specific operating case.

Further control with regard to the heating or cooling of the supporting or wiping strip 1 can also be carried out by the output of the delivery pump 4 being raised or lowered by the control unit 8.

If, during the operation of a system for paper production, it is established by the control unit 8 assigned to the supporting or wiping strip 1 that this supporting or wiping strip 1 has a temperature that is too low or too high for the relevant operating case or that too rapid a change in the temperature of this supporting or wiping strip 1 is taking place, as a result of which in each case there is the risk of cracking or fracture of the ceramic elements 1*b* of this supporting or wiping strip 1, this supporting or wiping strip 1 is supplied with appropriately heated or cooled carrier medium, which means that the ceramic elements 1*b* are not subjected to any impermissible thermal loadings, so that damage caused by this is avoided.

By means of this second method, irrespective of the particular operating circumstances, largely accurate control of the temperature of the relevant supporting or wiping strip is carried out.

In FIGS. 3 and 3A, FIGS. 4 and 4A to 4D, FIGS. 5 and 5A, FIG. 6, FIGS. 7 and 7A to 7C, FIGS. 8 and 8A, 8B, FIGS. 9 and 9A, FIGS. 10, 10A and 10B, a variety of embodiments of supporting or wiping strips 1 are illustrated. They comprise carrier strips 1*a* with plates 1*b* of ceramic material fixed to the latter and which are formed with channels 11 and 12, which pass through these supporting or wiping strips 1 in their longitudinal direction. In this case, these channels can begin at one end of the supporting or wiping strips 1 and end at the other end of the strips 1. As an alternative to this, these channels can begin at one end of the supporting or wiping strips 1 and be led back to this end. Furthermore, these channels can pass through the ceramic plates 1*b* or be provided in the carrier strip 1*a* or be located between the ceramic plates 1*b* and the carrier strip 1*a*. Moreover, the channels can be formed with different cross sections.

Since the plates 1*b* of ceramic material have a very low thermal conductivity, the arrangement of the channels within the supporting or wiping strips and the formation of the cross section is of the utmost importance, in order to ensure that, by means of the carrier medium flowing through these, the intended temperature of the plates 1*b* of ceramic material is achieved in order to prevent them from being damaged by thermal stresses.

The carrier medium used for cold and for heat is in particular water.

We claim:

1. In a paper production facility, a system for controlling a temperature of a ceramic element of a supporting or wiping strip assigned to a wire or a felt, the system comprising:

the supporting or wiping strip having at least one channel formed therein;

a feed line communicating with said at least one channel for conducting a carrier medium to the supporting or wiping strip; and a return line communicating with said at least one channel for conducting the carrier medium away from the supporting or wiping strip; and mixing valve communicating with said feed line for mixing a temperature carrier medium for heat and a temperature carrier medium for cold.

2. The system according to claim 1, which comprises a temperature sensor disposed in at least one of said feed line and/or said return line.

3. The system according to claim 1, which further comprises:

a line system having connected therein a delivery pump for the carrier medium, a heating device for heating the carrier medium, and a cooling device for cooling the carrier medium;

at least one temperature sensor disposed for determining a temperature of the carrier medium flowing away from the supporting or wiping strip; and a control unit configured to control at least one of said heating device, said cooling device, and said delivery pump.

4. The system according to claim 3, which further comprises at least one temperature sensor disposed to determine a temperature of the carrier medium being supplied to the supporting or wiping strip.

5. The supporting or wiping strip for the system according to claim 1, having at least one channel formed therein for conducting a carrier medium for heat or for cold therethrough.

6. The supporting or wiping strip according to claim 5, which comprises a plurality of ceramic elements defining a supporting surface of said supporting or wiping strip, and wherein said channel passes through said ceramic elements.

7. The supporting or wiping strip according to claim 5, which comprises a plurality of ceramic elements defining a supporting surface of said supporting or wiping strip and a carrier strip carrying said ceramic elements, and wherein said channel is formed between said ceramic elements and said carrier strip.

8. The supporting or wiping strip according to claim 7, wherein said ceramic elements and said carrier strip are formed with at least one channel or with channel portions.

9. The supporting or wiping strip according to claim 5, wherein said supporting or wiping strip is formed with a first and and a second end, and said channel begins at said first end and terminates at said second end.

10. The supporting or wiping strip according to claim 5, wherein said supporting or wiping strip is formed with a longitudinal end, and said channel has a forward portion beginning at said end and a return portion guided back and terminating at said end.

11. The supporting or wiping strip according to claim 10, wherein said forward portion of said channel is connected to said return portion of said channel within the supporting or wiping strip.

12. The supporting or wiping strip according to claim 10, which comprises a piece of pipe disposed externally of the supporting or wiping strip for connecting said forward portion of said channel with said return portion of said channel.

* * * * *